US007114923B2

(12) United States Patent
Liang

(10) Patent No.: US 7,114,923 B2
(45) Date of Patent: Oct. 3, 2006

(54) COOLING SYSTEM FOR A SHOWERHEAD OF A TURBINE BLADE

(75) Inventor: George Liang, Palm City, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 97 days.

(21) Appl. No.: 10/871,475

(22) Filed: Jun. 17, 2004

(65) Prior Publication Data

US 2005/0281675 A1 Dec. 22, 2005

(51) Int. Cl.
*F01D 5/08* (2006.01)

(52) U.S. Cl. ..... 416/97 R; 415/115

(58) Field of Classification Search ..... 416/97 R; 415/115

See application file for complete search history.

(56) References Cited

U.S. PATENT DOCUMENTS 4,203,706 A 5/1980 Hess
5,062,768 A 11/1991 Marriage
5,370,499 A 12/1994 Lee
5,383,766 A 1/1995 Przirembel et al.
5,496,151 A * 3/1996 Coudray et al. ..... 416/97 R
5,660,523 A 8/1997 Lee
6,099,251 A 8/2000 LaFleur
6,164,912 A * 12/2000 Tabbita et al. ..... 416/97 R
6,174,134 B1 1/2001 Lee et al.
6,331,098 B1 12/2001 Lee
6,379,118 B1 4/2002 Lutum et al.

* cited by examiner

*Primary Examiner*—Edward K. Look
*Assistant Examiner*—Richard A. Edgar

(57) ABSTRACT

A turbine blade for a turbine engine having an internal cooling system formed from at least one cavity for receiving cooling air from a turbine blade assembly, passing the cooling air through the internal cooling system, and expelling the cooling air through orifices in a leading edge forming a showerhead, orifices in a trailing edge and in other locations. The showerhead includes exhaust orifices extending at various angles relative to each other through an outer wall forming the turbine blade. The exhaust orifices may form rows of orifices that are offset generally orthogonally and generally parallel to a longitudinal axis of the blade. The exhaust orifices are configured to effectively cool the leading edge portion of the blade and to reduce the likelihood of cracking of the outer wall forming the leading edge.

24 Claims, 5 Drawing Sheets

COOLING SYSTEM FOR A SHOWERHEAD OF A TURBINE BLADE

FIELD OF THE INVENTION

This invention is directed generally to turbine blades, and more particularly to the cooling systems of turbine blades having internal cooling systems.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades, as shown in FIG. 1, are formed from a root portion at one end and an elongated portion forming a blade that extends outwardly from a platform coupled to the root portion at an opposite end of the turbine blade. The blade is ordinarily composed of a tip opposite the root section, a leading edge, and a trailing edge. The inner aspects of most turbine blades typically contain an intricate maze of cooling channels as shown in FIGS. 2 and 3 forming a cooling system. The cooling channels in the blades receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade.

Typically, conventional turbine blades have a collection of exhaust orifices in the leading edge forming a showerhead for exhausting cooling gases onto the leading edge of the turbine blade. Many conventional configurations of the showerhead orifices have the orifices aligned in the same orientation. Aligning the orifices in the same orientation of the showerhead often leads to cracking of the leading edge, as shown in FIG. 4, which is often referred to as zipper effect cracking as the cracks extend between adjacent orifices radially along the leading edge. Thus, a configuration of orifices for a leading edge is needed that produces an effective film cooling gas distribution and reduces the likelihood of zipper cracks forming in the leading edge of the blade.

SUMMARY OF THE INVENTION

This invention relates to a cooling system in a turbine blade capable of being used in turbine engines. The cooling system includes a plurality of exhaust orifices in a leading edge of the turbine blade forming a showerhead for providing film cooling gases to outer surfaces of the turbine blade. The exhaust orifices forming the showerhead may be positioned to reduce the likelihood of zipper effect cracking in the leading edge and to effectively cool the leading edge of the turbine blade.

The turbine blade may be formed from a generally elongated blade having a leading edge, a trailing edge, and a tip at a first end. The blade may also include a root coupled to the blade at an end generally opposite the first end for supporting the blade and for coupling the blade to a disc of a turbine blade assembly. The blade may also include one or more cooling cavities extending from the root through a substantial portion of the blade generally along a longitudinal axis of the blade for supplying cooling gases from the root to various portions of the turbine blade. A plurality of exhaust orifices at various locations across the turbine blade enable cooling gases flowing through the cooling cavities to be exhausted from the blade and used in film cooling applications on the turbine blade.

At least a portion of the exhaust orifices are positioned in the leading edge of the turbine blade forming a showerhead in which cooling gases from the cooling cavity is exhausted to be used in film cooling applications. The exhaust orifices extend from an outer surface of the turbine blade to the cooling cavity. The exhaust orifices form at least first and second rows of orifices positioned along the longitudinal axis of the blade. The first row of orifices may be offset from the second row of orifices orthogonal to the longitudinal axis of the blade. Some of the orifices forming the first row may extend through an outer wall of the turbine blade at a first angle relative to a longitudinal axis in a plane generally orthogonal to a chordwise direction, and other orifices forming the first row may extend through the outer wall at a second angle that differs from the first angle. In at least one embodiment, the first angle is measured moving from the longitudinal axis in a first direction in a plane generally orthogonal to a chordwise direction and the second angle is measured moving from the longitudinal axis in a second direction generally opposite to the first direction in a plane generally orthogonal to a chordwise direction. The first and second angles may or may not be equal, and may be between about five degrees and about 45 degrees. The second row may also be formed from orifices positioned at first and second angles relative to the longitudinal axis.

The first and second rows may be formed from an alternating pattern of orifices positioned in the first and second angles relative to the longitudinal axis. Additional rows may also be placed in the alternating pattern. Positioning the first and second rows in the alternating pattern reduces the likelihood that the leading edge will suffer a crack, often referred to as a zipper crack, in the outer wall of the turbine blade, even if the orifices are placed in a high density configuration. The orifices forming the first and second rows may also be formed in the following repeating pattern: an orifice at the first angle relative to the longitudinal axis, an orifice positioned along the longitudinal axis, an orifice at the second angle relative to the longitudinal axis, an orifice positioned along the longitudinal axis, and an orifice at the first angle relative to the longitudinal axis.

By positioning the exhaust orifices in the leading edge in these manners, the exhaust orifices provide more efficient convection on the leading edge and thereby reduce operating temperatures of the leading edge. In addition, these patterns of exhaust orifices increase the distances between adjacent exhaust orifices in the radial direction, which is along the longitudinal axis of the blade, and reduce the conduction distance between hot gas side surface in the chordwise direction, thereby increasing convection efficiency without compromising the strength of the leading edge. Instead, these patterns reduce the likelihood of zipper effect cracking along the leading edge.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
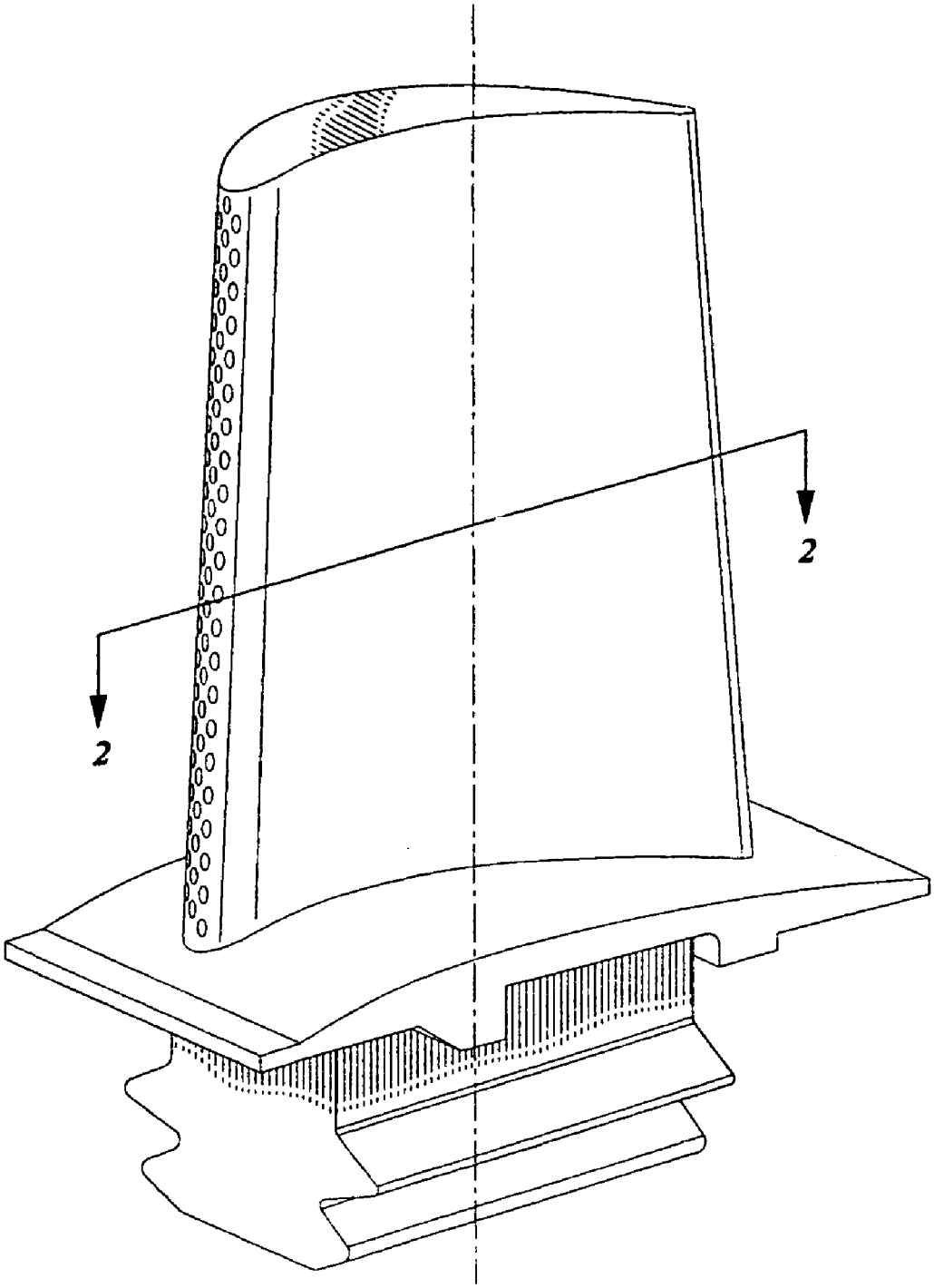
FIG. 1 PRIOR ART
FIG. 1 is a perspective view of a conventional turbine blade.
Figure 2:
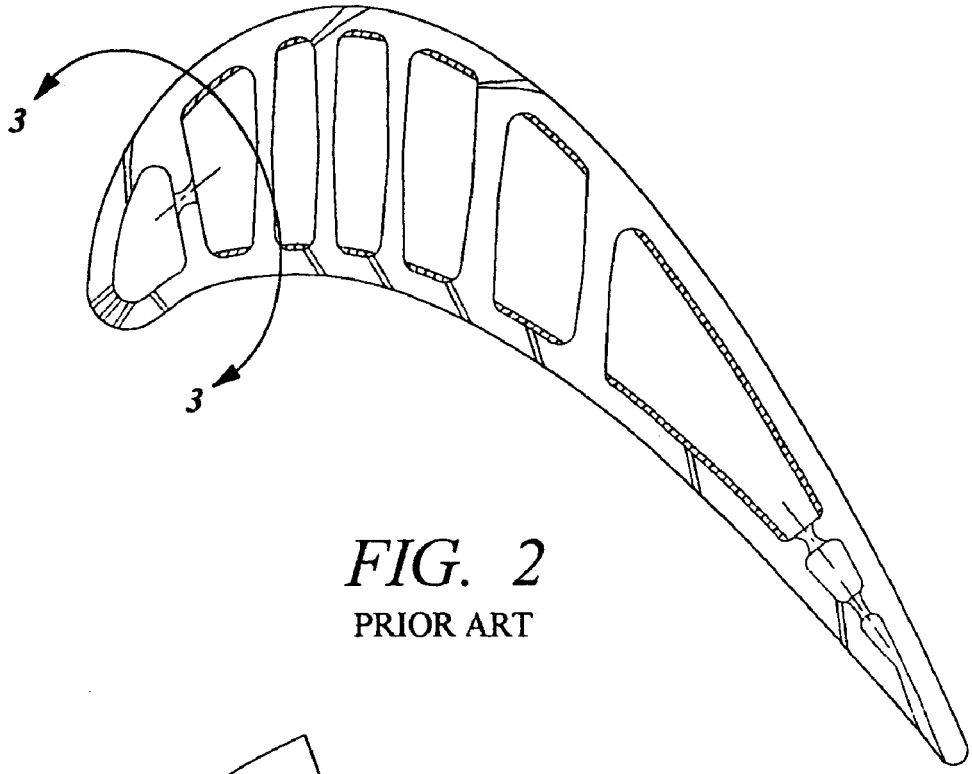
FIG. 2 PRIOR ART
FIG. 2 is cross-sectional view of the turbine blade shown in FIG. 1 taken along section line 2—2.
Figure 3:
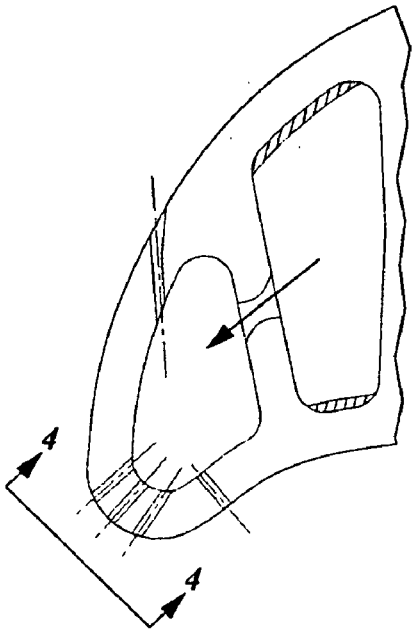
FIG. 3 PRIOR ART
FIG. 3 is a partial cross-sectional detail view of the turbine blade taken at detail 3 in FIG. 2.
Figure 4:
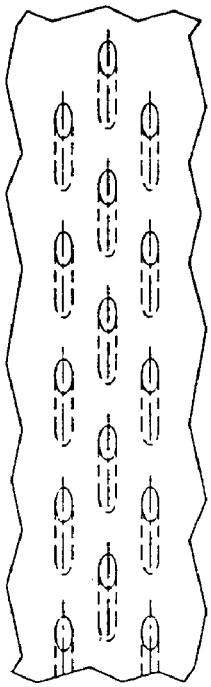
FIG. 4 PRIOR ART
FIG. 4 is a detail view of a leading edge shown in FIG. 3 viewed in the direction of arrow 4.
Figure 5:
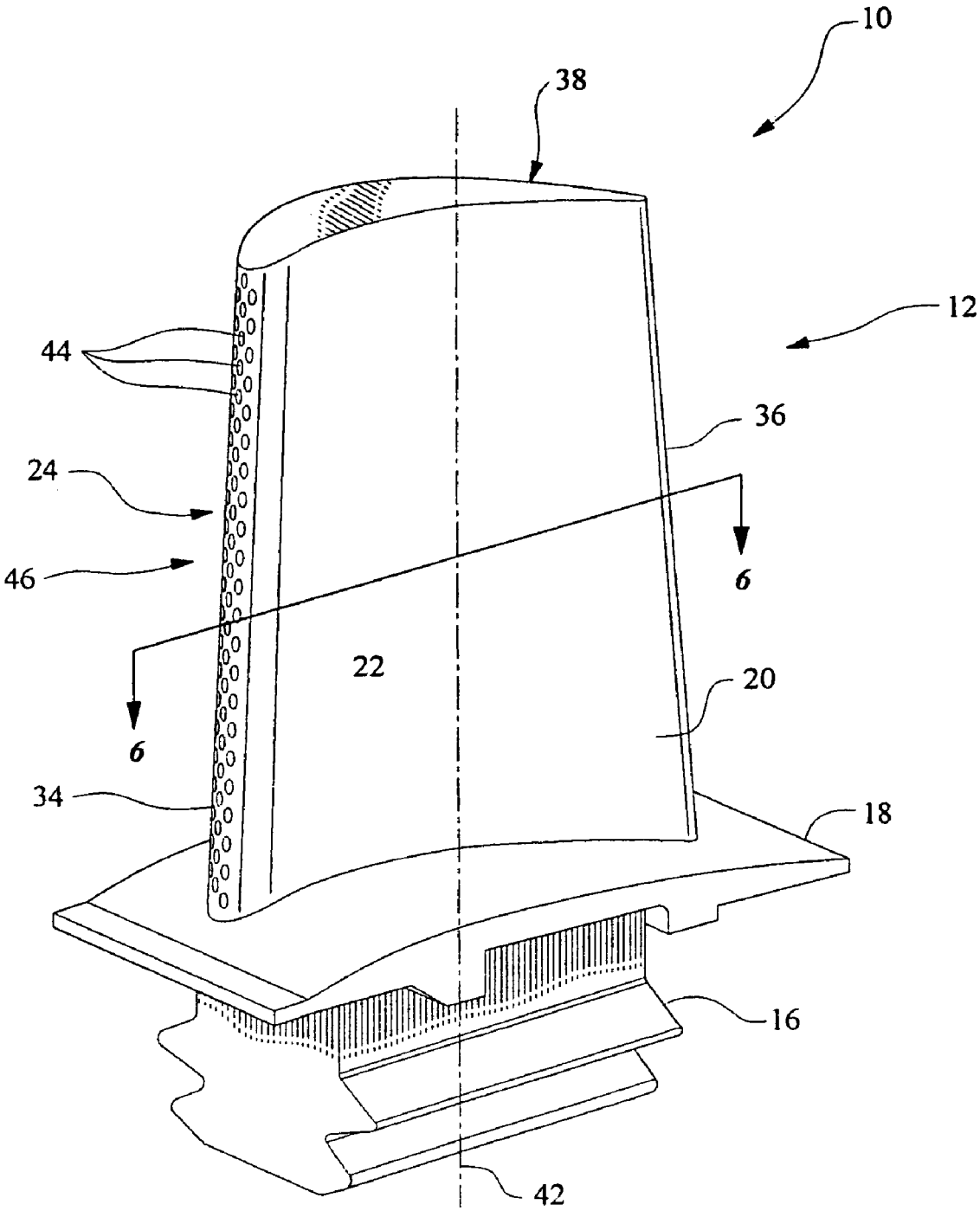
FIG. 5 is a perspective view of a turbine blade of this invention.
Figure 6:
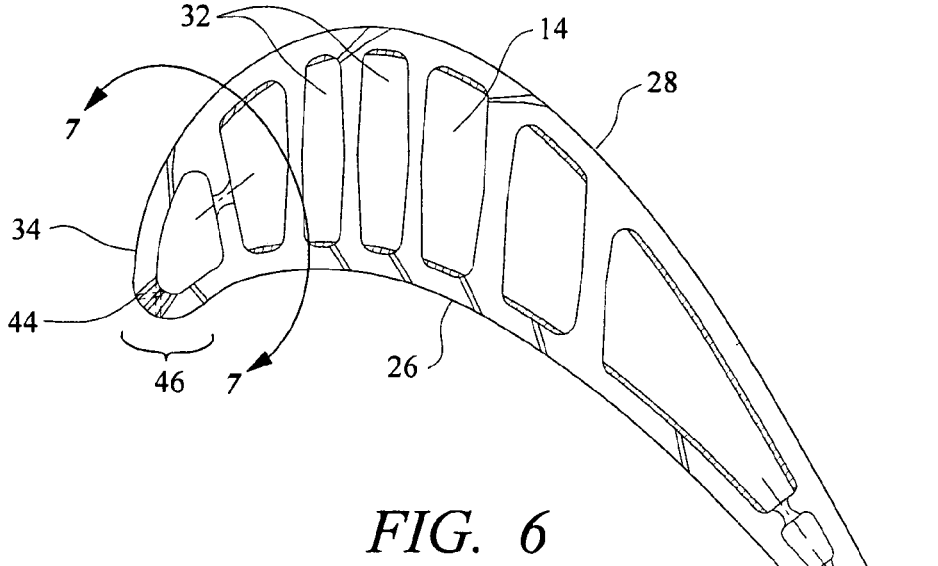
FIG. 6 is a cross-sectional view of the turbine blade shown in FIG. 5 taken along section line 6—6.
Figure 7:
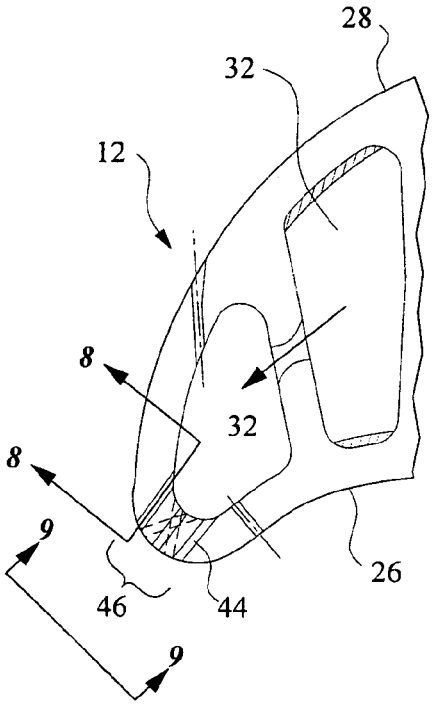
FIG. 7 is a partial cross-sectional detail view of the turbine blade taken at detail 7 in FIG. 6.

As shown in FIGS. 5–11, this invention is directed to a turbine blade cooling system 10 for turbine blades 12 used in turbine engines. In particular, turbine blade cooling system 10 is directed to a cooling system formed from a cavity 14, as shown in FIG. 6, positioned between two or more walls 24 of the turbine blade 12. As shown in FIG. 5, the turbine blade 12 may be formed from a root 16 having a platform 18 and a generally elongated blade 20 coupled to the root 16 at the platform 18. Blade 20 may have an outer surface 22 adapted for use, for example, in a first stage of an axial flow turbine engine. Outer surface 22 may be formed from walls 24 having a generally concave shaped portion forming pressure side 26 and may have a generally convex shaped portion forming suction side 28.

The blade 20 may include one or more cooling channels 32, as shown in FIG. 6, positioned in inner aspects of the blade 20 for directing one or more gases, which may include air received from a compressor (not shown), through the blade 20 and exhausted out of the blade 20. The cooling channels 32 are not limited to a particular configuration but may be any configuration necessary to adequately cool the blade 20. In at least one embodiment, as shown in FIG. 6, the cooling channels 32 may include a plurality of channels 32 extending generally along a longitudinal axis 42 of the blade 20. The blade 20 may be formed from a leading edge 34, a trailing edge 36, and a tip 38 at an end generally opposite to the root 16.

Figure 8:
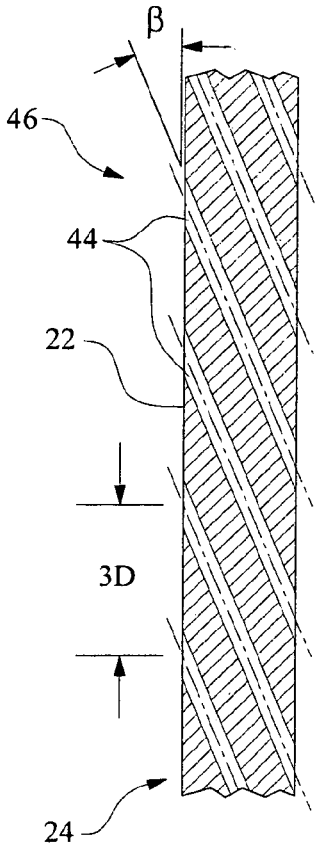
FIG. 8 is a partial cross-sectional view of the outer wall forming the leading edge shown in FIG. 7 taken at section line 8—8.

The leading edge 34 may include a plurality of exhaust orifices 44 forming a showerhead 46 for exhausting cooling an from the cooling channels 32 to flow along the outer surface 22 of the blade. The plurality of exhaust orifices 44 may form one or more rows of orifices 44. In at least one embodiment, a first row of exhaust orifices 48 and a second row of exhaust orifices 50 may be formed. The exhaust orifices 44 may be positioned in a nonorthogonal position relative to an outer surface 22 of the blade 20. For instance, as shown in FIG. 8, the exhaust orifices 44 may be positioned at an angle $\beta$ of between about 20 degrees and about 35 degrees relative to the outer surface 22 of the blade 20. The distance 3D between adjacent exhaust orifices 44 along the longitudinal axis 42 may be about three times the diameter of the exhaust orifices 44. The exhaust orifices 44 may be positioned such that air flowing from the root 16 through the cooling channels 32 radially outward toward the tip 38 may flow easily through the exhaust orifices 44.

Figure 9:
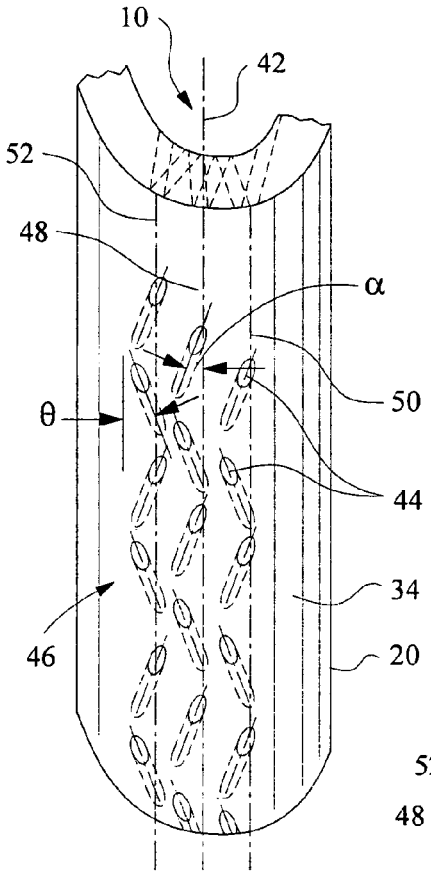
FIG. 9 is a detail view of the leading edge of the turbine blade shown in FIG. 7 as viewed in the direction of arrows 9.
Figure 10:
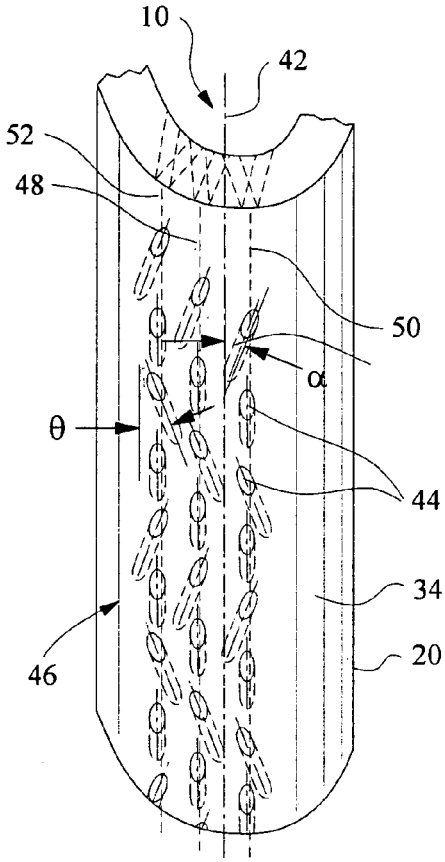
FIG. 10 is a detail view of the leading edge of the turbine blade having an alternative configuration of exhaust orifices as shown in FIG. 7 and viewed in the direction of arrows 9.

The first row 48 and the second row 50 of orifices 44 may be offset relative to each other generally orthogonal to the longitudinal axis 42 of the blade 20 such that the first and second rows 48, 50 generally follow the longitudinal axis 42. In at least one embodiment, as shown in FIGS. 9–10, a third row 52 may also be offset relative to each other generally orthogonal to the longitudinal axis 42 of the blade 20 such that the first and second rows 48, 50 generally follow the longitudinal axis 42. In addition to the rows 48, 50, 52 being offset orthogonally relative to the longitudinal axis 42, the first, second, and third rows 48, 50, 52 may be offset relative to each other along the longitudinal axis 42. In other words, the first, second, and third rows 48, 50, 52 may be offset radially along the blade 20.

In one embodiment, as shown in FIG. 9, the first row 48 may be formed from exhaust orifices 44 positioned at different angles from each other relative to the longitudinal axis 42. For instance, the first row 48 may be formed from exhaust orifices 44 at either a first angle $\alpha$ relative to the longitudinal axis 42 in a plane generally orthogonal to a chordwise direction or a second angle $\theta$ relative to the longitudinal axis 42 in a plane generally orthogonal to a chordwise direction. The first and second angles $\alpha$, $\theta$ may have a value between about five degrees and about 45 degrees. As shown in FIG. 9, the first row 48 may include exhaust orifices 44 that alternate between being positioned at a first angle $\alpha$ and positioned at a second angle $\theta$. The first angle $\alpha$ may be measured from the longitudinal axis 42 in a first direction, as indicated by an arrow on FIG. 9 for the first angle $\alpha$, in a plane generally orthogonal to a chordwise direction. The second angle $\theta$ may be measured from the longitudinal axis 42 in a second direction, as indicated by an arrow on FIG. 9 for the second angle $\theta$, in a plane generally orthogonal to a chordwise direction. In at least one embodiment, the first and second angles $\alpha$, $\theta$ have equal or substantially equal values. In other embodiments, the first and second angles $\alpha$, $\theta$ have different values.

As shown in FIG. 9, the first and second rows 48, 50 of orifices 44 may be formed from orifices 44 alternating between first and second angles $\alpha$, $\theta$ relative to the longitudinal axis 42. In addition, the pattern of alternating orifices 44 in the first and second rows 48, 50 may be coordinated between the rows. For instance, the orifices 44 forming the second row 50 may be in the same position as the orifices 44 forming the first row 48, except that rather than being positioned side by side, the orifices 44 in the second row 50 may be offset orthogonal to the longitudinal axis 42 and offset along the longitudinal axis 42. This same pattern may be extended to the third row 52 of orifices 44 and other rows as well.

The showerhead 46 may also be configured as shown in FIG. 10. For instance, the showerhead 46 may include orifices 44 forming the first, second, and third rows 48, 50, 52 of which one or more of the rows may have the following pattern. For instance, the first row 48 may have an orifice 44 positioned at the first angle α relative to the longitudinal axis 42, an orifice 44 positioned generally parallel to the longitudinal axis 42, an orifice 44 positioned at the second angle θ relative to the longitudinal axis 42, an orifice 44 positioned generally parallel to the longitudinal axis 42, and an orifice 44 positioned at the first angle α relative to the longitudinal axis 42. The orifices 44, may be spaced from each other within the row 48 a distance of about three times the diameter of the orifices 44. In another embodiment, as shown in FIG. 10, the orifices 44 may be spaced closer in a configuration referred to as a high density showerhead 46.

Figure 11:
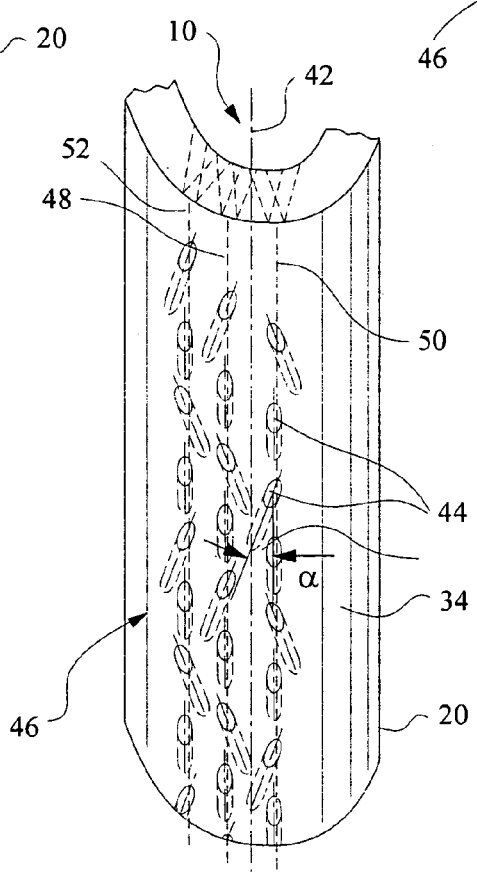
FIG. 11 is a detail view of the leading edge of the turbine blade having an alternative configuration of exhaust orifices as shown in FIG. 7 and viewed in the direction of arrows 9.

As shown in FIG. 11, the showerhead 46 may be configured such that two rows may have an alternating pattern of orifices 44. For instance, first and third rows 48, 52 may have the same pattern of angled orifices 44 that are offset from each other in a direction orthogonal to the longitudinal axis 42 and offset from each other in a direction along the longitudinal axis. However, second row 50 may have a pattern of orifices 44 aligned at the first and second angles α, θ that are opposite from the first and third rows 48, 52. In this spirit, the showerhead 46 may have orifices 44 positioned in other patterns other than shown in FIGS. 5–11. The patterns illustrated in FIGS. 5–11 are not mean to be limiting; rather, the patterns are mean to be illustrative of the patterns that may be created by placing the orifices 44 at the first and second angles α, θ. In at least one embodiment, adjacent rows 48, 50, 52 may each have different patterns of angluation of the orifices 42 forming the rows.

During operation, cooling gases, which may be air, is passed through the root 16 of the blade 12. The cooling gases flow throughout the internal cooling channels 32 of the blade 12 and are exhausted at various locations on the blade 12 for film cooling. At least a portion of the cooling fluids are exhausted through the orifices 44 forming the showerhead 46 in the leading edge 34. The cooling gases impede combustion gases flowing past the blade 12 from contacting the leading edge 34.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade formed front an outer wall and having a leading edge, a trailing edge, a tip at a first end, a root coupled to the blade at an end generally opposite the first end for supporting the blade and for coupling the blade to a disc, a longitudinal axis extending from the tip to the root, and at least one cooling cavity forming at least a portion of a cooling system;

a plurality of exhaust orifices in the leading edge of the blade forming a showerhead and extending nonorthogonally from an outer surface of the turbine blade to the at least one cooling cavity and in a chordwise direction;

wherein the exhaust orifices form at least one first row of orifices positioned alone the longitudinal axis of the blade and offset from a second row of orifices in a direction generally orthogonal to the longitudinal axis; and wherein at least a portion of the orifices forming the first row of orifices extend at a first angle relative to a longitudinal axis of the blade in a plane generally orthogonal to the chordwise direction through the outer wall to the at least one cooling cavity that differs from a second angle relative to a longitudinal axis of the blade in a plane generally orthogonal to the chordwise direction at which at least a portion of the second row of orifices extends through the outer wall;

wherein the first angle is measured moving from the longitudinal axis in a first direction, and the second angle is measured moving from the longitudinal axis in a second direction that is generally opposite to the first direction;

wherein at least a portion of the orifices forming the at least one first row of orifices form an alternating pattern of orifices positioned in the first and second angles relative to the longitudinal axis.

2. The turbine blade of claim 1, wherein the first angle is substantially equal to the second angle.

3. The turbine blade of claim 1, wherein the orifices forming the second row of orifices extend at a first angle relative to a longitudinal axis of the blade through the outer wall to the at least one cooling cavity that differs from a second angle relative to a longitudinal axis of the blade at which at least a portion of the second row of orifices extends through the outer wall.

4. The turbine blade of claim 3, wherein the orifices forming the first row of orifices are offset along the longitudinal axis relative to the second row of orifices.

5. The turbine blade of claim 4, wherein the exhaust orifices form a third row of orifices offset along the longitudinal axis relative to the first row of orifices.

6. The turbine blade of claim 1, wherein the first angle is between about five degrees and about 45 degrees.

7. The turbine blade of claim 1, wherein the second angle is between about five degrees and about 45 degrees.

8. The turbine blade of claim 1, wherein orifices of the first and second rows of orifices are offset along the longitudinal axis.

9. The turbine blade of claim 1, wherein the exhaust orifices form a third row of orifices offset along the longitudinal axis relative to the first row of orifices.

10. A turbine blade, comprising:

a generally elongated blade formed from an outer wall and having leading edge, a trailing edge, a tip at a first end, a root coupled to the blade at an end generally opposite the first end for supporting the blade and for coupling the blade to a disc, a longitudinal axis extending from the tip to the root, and at least one cooling cavity forming at least a portion of a cooling system;

a plurality of exhaust orifices in the leading edge of the blade forming a showerhead and extending nonorthogonally from an outer surface of the turbine blade to the at least one cooling cavity and in a chordwise direction;

wherein the exhaust orifices form at least one first row of orifices positioned along the longitudinal axis of the blade and offset from a second row of orifices in a direction generally orthogonal to the longitudinal axis; and wherein at least a portion of the orifices forming the first row of orifices extend at a first anal relative to a longitudinal axis of the blade in a plane generally orthogonal to the chordwise direction through the outer wall to the at least one cooling cavity that differs from a second angle relative to a longitudinal axis of the blade in a plane generally orthogonal to the chordwise direction at which at least a portion of the second row of orifices extends through the outer wall;

wherein the first angle is measured moving from the longitudinal axis in a first direction, and the second angle is measured moving from the longitudinal axis in a second direction that is generally opposite to the first direction;

wherein at least a portion of the orifices forming the at least one first row of orifices form an alternating pattern of orifices having the following pattern, an orifice positioned at the first angle relative to the longitudinal axis in a plane generally orthogonal to the chordwise direction, an orifice positioned generally along the longitudinal axis, and an orifice positioned at the second angle relative to the longitudinal axis in a plane generally orthogonal to the chordwise direction.

11. The turbine blade of claim 10, wherein at least a portion of the orifices forming the at least one first row of orifices form an alternating pattern of orifices having the following pattern, an orifice positioned at the first angle relative to the longitudinal axis in a plane generally orthogonal to the chordwise direction, an orifice positioned generally along the longitudinal axis, an orifice positioned at the second angle relative to the longitudinal axis in a plane generally orthogonal to the chordwise direction, an orifice positioned generally along the longitudinal axis, and an orifice positioned at the firs: angle relative to the longitudinal axis in a plane generally orthogonal to the chordwise direction.

12. A turbine bade, comprising:

a generally elongated blade formed from an outer wall and having a leading edge, a trailing edge, a tip at a first end, a root coupled to the blade at an end generally opposite the first end for supporting the blade and for coupling the blade to a disc, a longitudinal axis extending from the tip to the root and at least one cooling cavity forming at least a portion of a cooling system;

a plurality of exhaust orifices in the leading edge of the blade forming a showerhead and extending nonorthogonally from an outer surface of the turbine blade to the at least one cooling cavity and in a chordwise direction;

wherein the exhaust orifices form at least one first row of orifices positioned alone the longitudinal axis of the blade and offset from a second row of orifices in a direction generally orthogonal to the longitudinal axis; and wherein at least a portion of the orifices forming the first row of orifices extend at a first ankle relative to a longitudinal axis of the blade in a plane generally orthogonal to the chordwise direction through the outer wall to the at least one cooling cavity that differs from a second angle relative to a longitudinal axis of the blade in a plane generally orthogonal to the chordwise direction at which at least a portion of the second row of orifices extends through the outer wall;

wherein the exhaust orifices form a third row of orifices offset along the longitudinal axis relative to the first row of orifices.

13. The turbine blade of claim 12, wherein the first angle is measured moving from the longitudinal axis in a first direction, and the second angle is measured moving from the longitudinal axis in a second direction that is generally opposite to the first direction.

14. The turbine blade of claim 12, wherein the first angle is substantially equal to the second angle.

15. The turbine blade of claim 12, wherein the orifices forming the second row of orifices extend at a first angle relative to a longitudinal axis of the blade through the outer wall to the at least one cooling cavity that differs from a second angle relative to a longitudinal axis of the blade at which at least a portion of the second row of orifices extends through the outer wall.

16. The turbine blade of claim 15, wherein the orifices forming the first row of orifices are offset along the longitudinal axis relative to the second row of orifices.

17. The turbine blade of claim 12, wherein the first angle is between about five degrees and about 45 degrees and wherein the second angle is between about five degrees and about 45 degrees.

18. A turbine blade, comprising:

a generally elongated blade formed from an outer wall and having a leading edge, a trailing edge, a tip at a first end, a root coupled to the blade at an end generally opposite the first end for supporting the blade and for coupling the blade to a disc, a longitudinal axis extending from the tip to the root, and at least one cooling cavity forming at least a portion of a cooling system;

a plurality of exhaust orifices in the leading edge of the blade forming a showerhead and extending nonorthogonally from an outer surface of the turbine blade to the at least one cooling cavity;

wherein the exhaust orifices format least one first row of orifices positioned along the longitudinal axis of the blade and offset from a second row of orifices in a direction generally orthogonal to the longitudinal axis and offset in a direction generally parallel to the longitudinal axis; and wherein at least a portion of the orifices forming the first row of orifices alternate between extending at a first angle relative to a longitudinal axis of the blade through the outer wall to the at least one cooling cavity, wherein the first angle is measured moving from the longitudinal axis in a first direction in a plane generally orthogonal to a chordwise direction, and extending at a second angle relative to th outer wall, wherein the second angle is measured moving from the longitudinal axis in a second direction that is generally opposite to the first direction in a plane generally orthogonal to the chordwise direction.

19. The turbine blade of claim 18, wherein the first angle is substantially equal to the second angle.

20. The turbine blade of claim 18, wherein the exhaust orifices form a third row of orifices offset along the longitudinal axis relative to the first row of orifices.

21. The turbine blade of claim 18, wherein at least a portion of the orifices forming the at least one first row of orifices form an alternating pattern of orifices having the following pattern, an orifice positioned at the first angle relative to the longitudinal axis in a plane generally orthogonal to a chordwise direction, an orifice positioned generally along the longitudinal axis, and an orifice positioned at the second angle relative to the longitudinal axis in a plane generally orthogonal to the chordwise direction.

22. The turbine blade of claim 21, wherein at least a portion of the orifices forming the at least one first row of orifices farm an alternating pattern of orifices having the following pattern, an orifice positioned at the first angle relative to the longitudinal axis in a plane generally orthogonal to the chordwise direction, an orifice positioned generally along the longitudinal axis, an orifice positioned at the second angle relative to the longitudinal axis in a plane generally orthogonal to the chordwise direction, an orifice positioned generally along the longitudinal axis, and an orifice positioned at the first angle relative to the longitudinal axis in a plane generally orthogonal to the chordwise direction.

23. The turbine blade of claim 18, wherein the first angle is between about five degrees and about 45 degrees.

24. The turbine blade of claim 18, wherein the second angle is between about five degrees and about 45 degrees.

* * * * *